United States Patent [19]

Shibaoka et al.

[11] 4,272,613

[45] Jun. 9, 1981

[54] COLOR PHOTOGRAPHIC PROCESS

[75] Inventors: Haruo Shibaoka; Junkichi Ogawa, both of Minami-ashigara, Japan

[73] Assignee: Fuji Photo Film Co., Ltd., Minami-ashigara, Japan

[21] Appl. No.: 151,078

[22] Filed: May 19, 1980

[30] Foreign Application Priority Data

May 18, 1979 [JP] Japan ..... 54-61344

[51] Int. Cl.[3] ..... G03C 7/00;

[52] U.S. Cl. ..... 430/364; 430/363; 430/372; 430/468; 430/380; 430/384; 430/469; 430/963; 430/966;

[58] Field of Search ..... 430/364, 372, 468, 469, 430/471, 966, 963, 380

[56] References Cited

U.S. PATENT DOCUMENTS

| | | | |
|---|---|---|---|
| 3,512,979 | 5/1970 | Nagae et al. | 430/372 |
| 3,627,530 | 12/1971 | Umberger | 430/363 |
| 3,859,100 | 1/1975 | Kondo et al. | 430/600 |
| 3,955,983 | 5/1976 | Nakajima et al. | 430/364 |
| 3,994,729 | 11/1976 | Shibaoka | 430/418 |
| 4,049,454 | 9/1977 | Van Doorselaer et al. | 430/364 |
| 4,155,763 | 5/1979 | Hasebe et al. | 430/363 |

*Primary Examiner*—J. Travis Brown

*Attorney, Agent, or Firm*—Sughrue, Rothwell, Mion, Zinn and Macpeak

[57] ABSTRACT

A color photographic process is described for a silver halide photographic material having at least a silver halide emulsion layer containing a dye-forming coupler, comprising developing in a color developer solution containing components (1) an aromatic primary amino color developing agent, (2) a 1-aryl-3-pyrazolidone compound having two substituents at the 4-position, and (3) at least one compound selected from compounds represented by formulae (I) and (II):

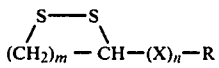

(I)

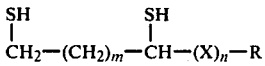

(II)

wherein X represents a hydrocarbon group having 1 to 6 carbon atoms; R represents a carboxylic acid group, a water-soluble carboxylic acid salt group, a water-soluble carboxylic acid ester group, or a water-soluble carboxylic acid amide group; m is 1 or 2; and n is 0 or 1; and then fixing by an acid hardening fix solution.

26 Claims, No Drawings

COLOR PHOTOGRAPHIC PROCESS

BACKGROUND OF THE INVENTION

1. Field of the Invention

The present invention relates to a color photographic process and, in particular, to a color photographic process giving high sensitivity, contrast, and maximum density, as well as less fog, under rapid processing condition. More particularly, the invention relates to a color photographic process wherein silver images and dye images obtained by color development are used as color photographic images.

2. Description of the Prior Art

In photographic processing for obtaining color photographic images by processing silver halide color photographic materials, it is well known to obtain color photographic images by forming dyes by the imagewise coupling of an oxidized aromatic primary amine developer and dye-forming couplers. Also, a color photographic process wherein color photographic images composed of dyes and silver are formed by processing coupler-containing photographic materials using the steps of color development, fixing, washing, and drying, without employing a silver removal process, is known, as disclosed in U.S. Pat. Nos. 3,622,626, 3,627,530, 3,734,735, and 3,809,906, British Pat. No. 1,122,085, West German Patent Application (OLS) No. 1,158,836 and Japanese Patent Application (OPI) No. 37539/72 (the term "OPI" as used herein refers to a "published unexamined Japanese patent application").

Color photographic materials using images composed of dyes and silver have advantages, in that the amount of imaged information is large, owing to high discrimination and good granularity, and the amount of silver halide contained in the photographic materials may be reduced, and therefore this photographic technique for color photographic materials is effectively applied to radiographic materials (requiring a large amount of silver halide), photosensitive materials for making printing plates, and so forth.

Considering the purposes of radiographic materials, photosensitive materials for making printing plates, etc., these materials are not required to form multicolored photographic images, and may be monochromic color photographic materials. Desirably they are photographic materials forming black images.

These photographic materials are usually processed by rapid processing and a rapid process using an automatic processor has been widely employed. Very rapid processing is particularly required for radiographic materials, for the purpose of interpretation and use of the X-ray image as soon as possible, and it is now common to finish the total processing steps of development, fixing, washing, and drying within 2 minutes for black and white radiographic materials.

Therefore, color radiographic materials should be able to be processed rapidly also, as in the case of black and white radiographic materials.

Various attempts have been proposed for increasing the processing speed of color development, and of these attempts, a process of performing color development in the presence of an aromatic primary amino color developing agent, a hydroxylamine derivative, and a 1-aryl-3-pyrazolidone derivative having two substituents at the 4-position disclosed in U.S. Pat. No. 4,155,763 is effective.

In rapid processing, it is of course necessary that the process steps other than development also be conducted rapidly. That is, it is also required to rapidly conduct the other steps of fixing, washing, and drying. To increase the processing speed for the fixing and washing steps, the use of an acid hardening fix solution as described in U.S. Pat. No. 3,994,729 is effective.

It is, however, known that when photographic materials are processed by an acid hardening fix solution after the formation of dyes and silver images using a color developer, a part of the dye formed in the color development step is destroyed.

The occurrence of such a phenomenon can be prevented by using an alkaline fix solution as the fixing solution, as is described in Japanese Patent Application (OPI) No. 99522/76.

However, when an alkaline fix solution is used in the fixing step, the gelatin in the photographic material is swelled very greatly, and the gelatin-containing layers absorb a large amount of water in the washing step, thereby the burden of drying the photographic materials becomes that large it becomes impossible to dry the photographic materials to the necessary level using an ordinary high speed automatic processor.

Thus, in the case of rapid processing of a color photographic material containing at least one kind of color-forming coupler, including the steps of development, fixing, washing and drying, it is necessary, to obtain a completely dried photographic film, to use an acid hardening fix solution as the fix solution. However, the use of an acid hardening fix solution is undesirable in that a part of the dye formed in the development step is destroyed in the fixing step, thereby reducing the photographic sensitivity, contrast, and maximum density. Also, it has been confirmed that silver of the images formed by the development takes part in the destruction of the dyes. Therefore, the extent of the destruction of the dyes becomes larger at portions of the image having high image density. Therefore, the image density at high density portions which are particularly important in the case of color radiographic materials, is adversely affected by the above-mentioned phenomenon. Hence, it is important to overcome such problems in the art as have been described above.

SUMMARY OF THE INVENTION

An object of this invention is to provide a photographic processing technique which can overcome the difficulties encountered using conventional techniques.

More particularly, an object of this invention is to provide a color photographic process capable of providing rapid color development.

Another object of this invention is to provide a color photographic process capable of forming images having high density.

Other objects of this invention will become apparent from the following detailed description of the specification.

The objects of this invention can be attained by a color photographic process comprising developing an imagewise exposed silver halide photographic material containing a dye-forming coupler by a color developer solution (also sometimes referred to simply as the "color developer" or the "developer") containing components (1) an aromatic primary amino color developing agent, (2) a 1-aryl-3-pyrazolidone compound having two substituents at the 4-position, and (3) at least one compound selected from compounds represented by formulae (I) and (II):

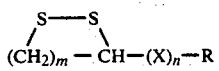

(I)

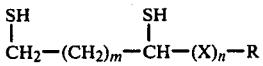

(II)

wherein X represents a hydrocarbon group having 1 to 6 carbon atoms; R represents a carboxylic acid group, a water-soluble carboxylic acid salt group, a water-soluble carboxylic acid ester group, or a water-soluble carboxylic acid amide group; m is 1 or 2; and n is 0 or 1, and then fixing the photographic material by an acid hardening fix solution.

That is, it has been discovered that by using a compound as shown by formula (I) and/or formula (II), the dye images formed by the color development can be processed in the subsequent step or steps without fading, and hence the density of the dye images is maintained in the fixing step, even when using an acid fixing solution.

DETAILED DESCRIPTION OF THE INVENTION

Examples of preferred X is an alkylene group, such as methylene group, ethylene group, propylene group, etc.

As preferred examples of water-soluble carboxylic acid salt, there are alkali metal salts (e.g., sodium salt, potassium salt, etc.), alkaline earth metal salts (e.g., calcium salt, barium salt, etc.), ammonium salt, amine salts (e.g., methylamine salt, ethylamine salt, ethanolamine salts) and the like.

As preferred examples of water-soluble carboxylic acid esters, there are esters with $C_1$–$C_4$ alkyl group.

Examples of preferred carboxylic acid amides are carboxylic acid amide (i.e., $—CONH_2$) and carboxylic acid amide substituted with a $C_1$–$C_4$ alkyl group.

Practical examples of particularly useful compounds shown by the above-described formulae (I) and (II) are shown below, although the compounds of formulae (I) and (II) useful in this invention are not limited to these compounds only.

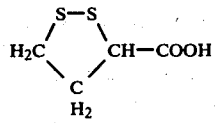

(1)

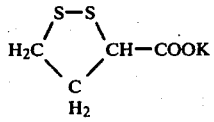

(2)

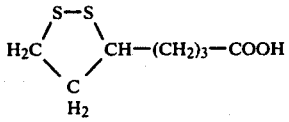

(3)

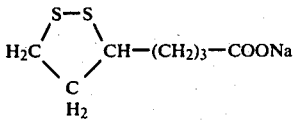

(4)

-continued

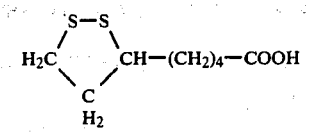

(5)

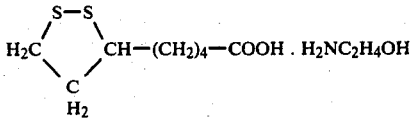

(6)

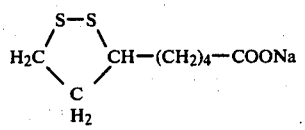

(7)

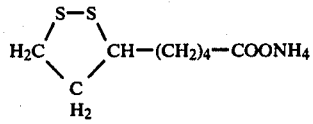

(8)

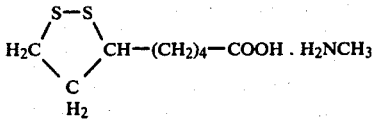

(9)

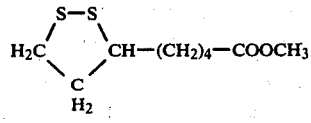

(10)

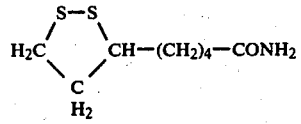

(11)

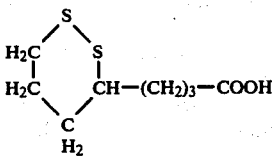

(12)

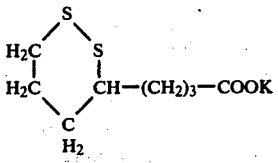

(13)

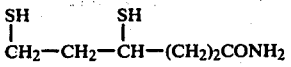

(14)

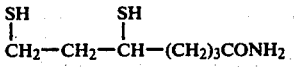

(15)

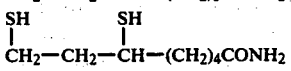

(16)

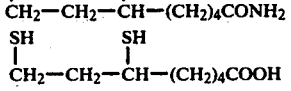

(17)

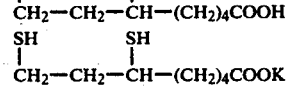

(18)

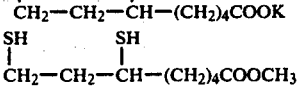

(19)

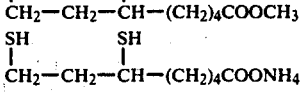

(20)

The compound represented by formula (I) or (II) can be synthesized according to known processes, e.g., described in *Journal of the American Chemical Society*, Vol. 76, pp. 1828–1832 (1954).

Some of the compounds of formulae (I) and (II) according to this invention are known as a photographic anti-foggant, for example, as described in U.S. Pat. No. 3,859,100. However, the effect of this invention (i.e., preventing destruction of dye image) is quite different from anti-fogging action. Further, a usual anti-foggant has a defect of decrease in developing speed, but the compounds of formulae (I) and (II) according to this invention have an unexpected effect on preventing destruction of dye image without decrease in developing speed.

The amount of the compound of the formulae (I) and (II) used is from about 0.01 g to 5.0 g, and preferably is from 0.05 g to 2.0 g, per liter of color developer solution.

The color developer solution used in this invention contains (1) an aromatic primary amino color developing agent, and preferred examples thereof include the following p-phenylenediamine derivatives: N,N-diethyl-p-phenylenediamine hydrochloride, 2-amino-5-diethylaminotoluene hydrochloride, 2-amino-5-(N-ethyl-N-laurylamino)toluene, 4-N-ethyl-N-(β-hydroxyethyl-)amino aniline sulfate, 2-methyl-4-N-ethyl-N-(β-hydroxyethyl)amino aniline sulfate, N-ethyl-N-(β-methanesulfonamidoethyl)-3-methyl-4-aminoaniline sesquisulfate monohydrate as described in U.S. Pat. No. 2,193,015, N-(2-amino-5-diethylaminophenylethyl)methane sulfonamide sulfate and N,N-dimethyl-p-phenylenediamine hydrochloride as described in U.S. Pat. No. 2,592,364, 4-amino-3-methyl-N-ethyl-N-methoxyethylaniline, 4-amino-3-methyl-N-ethyl-N-β-ethoxyethylaniline, 4-amino-3-methyl-N-ethyl-N-β-butoxyethylaniline, and the salts (e.g., sulfates, hydrochlorides, sulfites, p-toluenesulfonates, etc.) thereof as described in U.S. Pat. Nos. 3,656,950, 3,698,525, and so forth.

It is preferred that the amount of the color developing agent is generally from about 0.1 to 50 g, and more preferably is from 1 to 20 g, per liter of color developer solution.

The color developer solution used in this invention contains a 1-aryl-3-pyrazolidone compound having two substituents at the 4-position as component (2); examples of such substituents include alkyl groups having from 1 to 4 carbon atoms, and substituted alkyl groups. Examples of the substituent of the substituted alkyl groups include a hydroxy group, an ether group (especially, an alkoxy group having 1 to 4 carbon atoms), an ester group (especially, an alkyl ester group having 1 to 4 carbon atoms), an amide group (e.g., sulfonamide group) and a halogen atom (e.g., a chlorine atom, a bromine atom, an iodine atom). More specifically, such substituents include a hydroxyalkyl (e.g., hydroxyethyl, hydroxymethyl, etc.), an alkyl substituted by sulfonamide (e.g., methanesulfonamidoethyl), and an alkyl substituted by alkoxy group (e.g., methoxyethyl group, ethoxyethyl group, etc.), and the like. In particular, an alkyl group substituted by a hydrophilic substituent is preferred, and a hydroxyalkyl group is more preferred.

In particular, the hydroxyalkyl-substituted 1-aryl-3-pyrazolidone compound is preferred since less fog is produced in performing color development therewith, and it shows good solubility in color developer solution. The aryl group at the 1-position of the 1-aryl-3-pyrazolidone compound used in this invention can be a phenyl group, including a substituted phenyl group. As the substituent of the substituted phenyl group, groups having a substituent constant $\sigma$ of from about $-0.9$ to $+0.9$, and preferably is from $-0.40$ to $+0.25$. The substituent constant $\sigma$ refers to the value of the Hammett's constant described in H. H. Jaffé, *Chemical Review*, Vol. 53, 191 (1953). Useful examples of substituents showing such a value, and the substituted positions, are p—OH, p—$CH_3O$, m—$(CH_3)_2N$, p—$(CH_3)_3C$, p—$CH_3$, m—$NH_2$, p—$C_2H_5$, p—$(CH_3)_2CH$, m—$(CH_3)_3Si$, m—$CH_3$, p—$CH_3S$, p—$C_6H_5O$, p—$NHCOCH_3$, m—OH, p—$C_6H_5$, p—F, m—$CO_2^{\ominus}$, m—$CH_3O$, p—$CO_2^{\ominus}$, m—$CH_3S$, m—$C_6H_5$, p—Cl, and p—Br.

These substituents may be present as a combinations thereof. If a substituent is introduced to the aryl group, the reducing power thereof can be changed.

Since the reducing power changes depending upon the above-described substituent constant, preferred substituents can be selected in the range of the substituent constant described above according to the kind of the color developing agent to be combined and the use thereof.

The above-mentioned substituents introduced to the p-position can prevent the formation of a specific green-blue material that could otherwise be formed when adding a 1-phenyl-3-pyrazolidone compound to a color developer solution, and can also prevent the deterioration of the color developer solution caused by the formation of such a material.

Specific examples of the 1-aryl-3-pyrazolidone compounds that can be used in this invention are illustrated below.

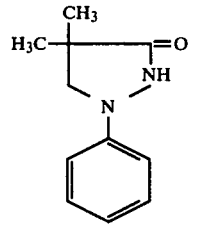

(I)

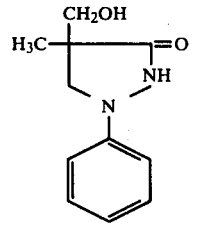

(II)

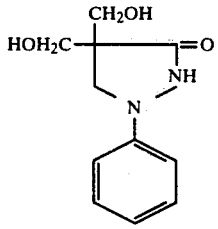

(III)

-continued (IV)

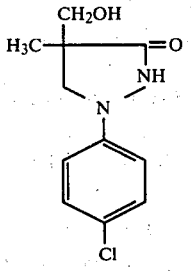

(V)

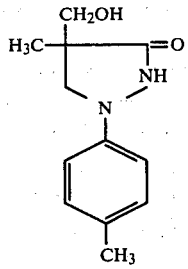

(VI)

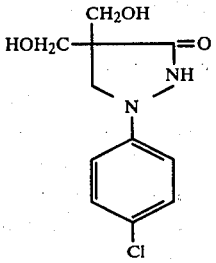

(VII)

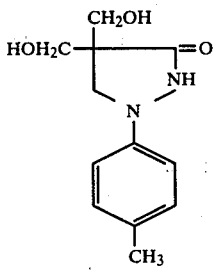

(VIII)

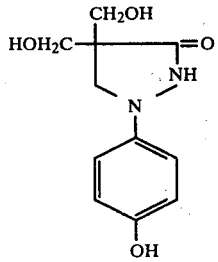

(IX)

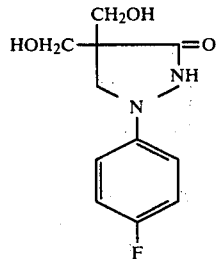

-continued (X)

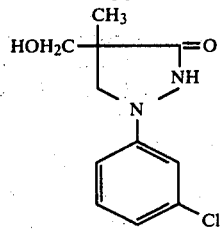

(XI)

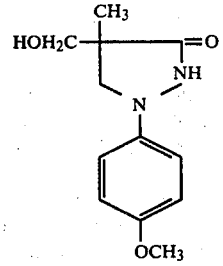

The amount of the 1-aryl-3-pyrazolidone compound used is from about 0.01 g to 10 g, and preferably is from 0.05 g to 5 g, per liter of color developer solution.

A hydroxylamine derivative may be used in the color developer solution in order to help stabilize the 3-pyrazolidone. Examples of the hydroxylamine derivatives that can be used in this invention include: hydroxylamine; N-monoalkylhydroxylamines, such as N-methylhydroxylamine hydrochloride; N,N-diethylhydroxylamines; aminoalkylhydroxylamines as described in U.S. Pat. No. 3,287,125; the alkoxyhydroxylamines as described in U.S. Pat. No. 3,293,034; the sulfohydroxylamines described in U.S. Pat. No. 3,287,124; N,N-dialkylhydroxylamines; and heterocyclic N-hydroxylamines, such as N-hydroxypiperidine. They may be used as they are or as the salts thereof but usually from the commercial viewpoints, such as cost, stability, water solubility, supplying stability, usable aptitude, etc., hydroxylamine sulfate, hydroxylamine hydrochloride, N,N-diethylhydroxylamine, N,N-diethylhydroxylamine oxalate, etc., are preferred.

In particular, N,N-diethylhydroxylamine is effective for the stabilization of the 3-pyrazolidone and is preferably used in this invention.

The amount of the hydroxylamine derivative used in this invention is from 0.05 to 10 g, and preferably is from 0.1 to 5 g per liter of the color developer.

The color developer solution containing the 3-pyrazolidone used in this invention may further contain a sulfite such as sodium sulfite, potassium sulfite, potassium hydrogensulfite, sodium hydrogensulfite, etc., usually used, as other antioxidant than the hydroxylamine derivative.

The color developer solution may also contain various other compounds used with known developers. For example, sodium hydroxide, potassium hydroxide, sodium carbonate, potassium carbonate, sodium tertiary phosphate, potassium tertiary phosphate, potassium metaborate, borax, etc., can be used solely, or in combination, as an alkali agent, a buffer, and so forth. Also, for the purposes of buffering, facilitating the preparation of the color developer, and increasing the ionic strength, various salts such as disodium hydrogenphosphate, dipotassium hydrogenphosphate, sodium dihydrogenphosphate, potassium dihydrogenphosphate, sodium hydrogencarbonate, potassium hydrogenphosphate, boric acid, an alkali nitrate, an alkali sulfate, etc., can also be used in the color developer solution.

Furthermore, the color developer solution used in this invention may, if desired, contain a desired development accelerator. Examples of such development accelerators are, for example, the various pyridinium compounds and other cationic compounds described in U.S. Pat. No. 2,648,604; Japanese Patent Publication No. 9503/69 and U.S. Pat. No. 3,671,247; cationic dyes such as phenosafranine; neutral salts such as thallium nitrate and potassium nitrate; polyethylene glycol and the derivatives thereof described in Japanese Patent Publication No. 9504/69 and U.S. Pat. Nos. 2,533,990, 2,531,832, 2,950,970 and 2,577,127; nonionic compounds such as polythioethers; the organic solvents and organic amines described in Japanese Patent Publication No. 9509/69 and Belgiam Pat. No. 682,862; ethanolamine; ethylenediamine; and diethanolamine, as well as other accelerators, as described in L. F. A. Mason, *Photographic Processing Chemistry,* pp. 40-43 (1966), Focal Press, London. Other examples of useful development accelerators that can be used in this invention are benzyl alcohol and phenylethyl alcohol as described in U.S. Pat. No. 2,515,147 and pyridine, ammonia, hydrazine and amines described in *Journal of the Society of Photographic Science and Technology of Japan,* Vol. 14, p. 74 (1952).

The color developer used in this invention may further contain, if necessary, an anti-foggant. Examples of the anti-foggant that can be used in this invention include metal halides, such as sodium bromide, potassium iodide, potassium bromide, etc., and organic anti-foggants. Examples of such organic anti-foggant include nitrogen-containing heterocyclic compounds such as benzotriazole, 6-nitrobenzimidazole, 5-nitroindazole, 5-methylbenzotriazole, 5-nitrobenzotriazole, 5-chlorobenzotriazole, etc.; mercapto-substituted heterocyclic compounds such as 1-phenyl-5-mercaptotetrazole, 2-mercaptobenzimidazole, 2-mercaptobenzothiazole, etc., and mercapto-substituted aromatic compounds such as thiosalicylic acid, etc. Preferred anti-foggants are nitrogen-containing heterocyclic compounds, and particularly preferred are nitrogen-containing heterocyclic compounds which are not substituted with a mercapto group. The anti-foggant is used in an amount of from about 1 mg to 5 g, and preferably from 5 mg to 1 g, per liter of color developer solution.

Furthermore, the color developer solution used in this invention may contain polyphosphoric acid compounds, such as sodium hexametaphosphate, sodium tetrapolyphosphate, sodium tripolyphosphate, potassium hexametaphosphate, potassium tetrapolyphosphate, potassium tripolyphosphate, and so forth, and, as a water softener, aminopolycarboxylic acids, such as ethylenediaminetetraacetic acid, nitrilotriacetic acid, cyclohexanediaminetetraacetic acid, iminodiacetic acid, N-hydroxymethylethylenediaminetriacetic acid, diethylenetriaminepentaacetic acid, and so forth. The amount of the water softener used depends upon the hardness of water used, but it is usually used in an amount from about 0.5 to 1 g per liter of color developer solution. Moreover, a calcium or magnesium chelating agent may be used in the color developer solution, and such materials are described in J. Willems, *Belgische Chemische Industrie,* Vol. 21, p. 325 (1956) and ibid., Vol. 23, p. 1105 (1958).

Still further, the color developer solution may contain: stain or sludge preventing agents, as described in U.S. Pat. Nos. 3,161,513 and 3,161,514 and British Pat. Nos. 1,030,442, 1,144,481 and 1,251,558; solvents such as diethylene glycol, etc.; and color formers, such as couplers.

The color developer solution employed in this invention is an aqueous color developer solution and the solvents such as diethylene glycol, etc., above are additionally employed.

The pH of the color developer solution is desirably from about 7 to 14, and preferably from about 8 to 13. The temperature of the color developer is in the range of from about 20° to 70° C., and preferably is from 30° to 60° C.

The acid-hardening fixing solution used in this invention may be an aqueous solution containing a thiosulfate and a water-soluble aluminum compound, and has preferably a pH value of from about 3.6 to 5.5 (at 20° C.).

In the process of this invention, a stop step may be employed after development but the stop step is generally omitted in an automatic processor for rapid processing, which causes a problem in that some developer is partially carried into the fixing solution, increasing the pH of the fixing solution, and hence the drying process for the photographic films processed in such a fixing solution tends to be prolonged, due to the swelling phenomenon of the gelatin-containing layers. Consequently, it is desirable that the pH of the fixing solution used in this invention be adjusted to from about 3.8 to 4.8 (at 20° C.). An example of a fixing agent that can be used in this invention is a thiosulfate, such as ammonium thiosulfate, sodium thiosulfate, etc., but a fixing solution composed mainly of ammonium thiosulfate is particularly preferred for rapid processing. The amount of the fixing agent may be properly changed but is generally from about 0.1 mol to 5 mols per liter of fixing solution.

A water-soluble aluminum salt is generally used as the hardening agent in the fixing solution, and examples of such a salt include aluminum chloride, aluminum sulfate, potassium alum, ammonium alum, etc.

The fixing solution used in this invention may contain, if desired, a preservative (e.g., sulfite, hydrogensulfite, etc.), a pH buffer (e.g., boric acid, borate, etc.), a pH controlling agent (e.g., acetic acid, citric acid, tartaric acid, etc., or the salts of these acids), a chelating agent (e.g., ethylenediaminetetraacetate, etc.), as well as other materials conventionally used in fixing solutions.

The process for color photographic materials in this invention does not include a silver-removing step, and is therefore different from the process for ordinary color photographic materials and are fundamentally composed of the steps of color development, fixing, washing, and drying, and for the processing steps, an automatic processor of a roller conveyor type, a belt conveyor type, or a chain conveyer type is generally used.

It is desirable that the total processing time by an automatic processor be from about 30 seconds to 5 minutes, and preferably from 1 minute to 2 minutes and 30 seconds. Also, it is preferred that the processing temperature be from about 10° to 50° C., and preferably from 25° to 45° C.

For the photographic materials processed according to this invention, any supports used for ordinary photographic materials can be used. For example, cellulose nitrate films, cellulose acetate films, cellulose acetate butyrate films, cellulose acetate propionate films, polystyrene films, polyethylene terephthalate films, polycarbonate films, laminates of these films, papers, etc., can be used and these films may be colored.

Also, for photographic materials processed according to this invention, various hydrophilic colloids are used. As hydrophilic colloids used as binders for silver halide photographic materials and/or for other photographic layers constituting such compositions, there are, for example, gelatin, colloidal albumin, casein, cellulose derivatives such as carboxymethyl cellulose, hydroxymethyl cellulose, etc., sugar derivatives such as agar agar, sodium alginate, starch derivatives, etc., and synthetic hydrophilic colloids such as polyvinyl alcohol, poly-N-vinylpyrrolidone, polyacrylic acid copolymer, polyacrylamide, the derivatives of these polymers, and partially hydrolyzed products of these polymers. Among these materials, gelatin is most generally used.

The silver halide emulsion layers or other photographic layers of the photographic materials processed according to this invention may further contain synthetic polymers such as vinyl polymer latex, e.g., dispersed in water. Preferred are polymers capable of improving the dimensional stability of the photographic materials, either solely or as a mixture of different kinds of polymers, or further as a combination of the polymer or polymers and a hydrophilic water-permeable colloid.

The silver halide emulsion layers and other photographic layers processed according to this invention can be hardened in the conventional manner. Examples of a hardening agent used for hardening such photographic layers are aldehyde series compounds, such as formaldehyde, glutaraldehyde, etc.; ketone compounds, such as diacetyl, cyclopentanedione, etc.; bis(2-chloroethylurea); 2-hydroxy-4,6-dichloro-1,3,5-triazine; the compounds having reactive halogen as shown in U.S. Pat. Nos. 3,288,775 and 2,732,303 and British Pat. Nos. 974,723 and 1,167,207; divinylsulfone; 5-acetyl-1,3-diacryloylhexyhydro-1,3,5-triazine; compounds having reactive olefin, as shown in U.S. Pat. Nos. 3,635,718, 3,232,763, 3,490,911 and 3,642,486 and British Pat. No. 994,869; N-hydroxymethylphthalimide; N-methylol compounds as shown in U.S. Pat. Nos. 2,732,316 and 2,586,168; the isocyanates as shown in U.S. Pat. No. 3,103,437; aziridine compounds, as shown in U.S. Pat. Nos. 3,017,280 and 2,983,611; acid derivatives, as shown in U.S. Pat. Nos. 2,725,294 and 2,725,295; carbodiimides, as shown in U.S. Pat. No. 3,100,704; epoxy compounds, as shown in U.S. Pat. No. 3,091,537; isooxazole series compounds, as shown in U.S. Pat. Nos. 3,321,313 and 3,543,292; halogenocarboxyaldehydes, such as mucochloric acid, etc.; dioxane derivatives such as dihydroxydioxane, dichlorodioxane, etc.; and so forth. Furthermore, inorganic hardening agents such as chromium alum, zirconium sulfate, etc., may be also used according to this invention.

The above-described silver halide photographic emulsions in this invention may further contain various compounds for preventing reductions in sensitivity or formation of fog during the production and storage of the photographic materials, and for during the processing thereof. Examples of such compounds include many heterocyclic compounds, such as 4-hydroxy-6-methyl-1,3,3a,7-tetrazaindene, 3-methylbenzothiazole, 1-phenyl-5-mercaptotetrazole, etc., mercury-containing compounds, mercapto compounds, metal salts, etc., which are well known.

The silver halide photographic emulsions used in this invention contain couplers, i.e., compounds forming dyes by reaction with an oxidized developing agent.

So-called black coloring coupler, which forms a black color by the coupler itself, can be used, such as m-aminophenol series compounds such as, for example, the compounds described in Japanese Patent Application (OPI) No. 42725/77; the resorcin series compounds described in West German Patent Application (OLS) No. 2,825,883; and the compounds described in U.S. Pat. Nos. 2,181,994, 2,310,982 and 2,333,106.

The silver halide emulsions in this invention may contain yellow couplers, such as diketomethylene series compounds. Examples of such yellow couplers are described in, for example, U.S. Pat. Nos. 3,341,331, 2,875,057 and 3,551,155, West German Patent Application (OLS) No. 1,547,868, U.S. Pat. Nos. 3,265,506, 3,582,322, and 3,725,072, West German Patent Application (OLS) No. 2,162,899, U.S. Pat. Nos. 3,369,895 and 3,408,194, and West German Patent Application (OLS) Nos. 2,057,941, 2,213,461, 2,219,917, 2,261,361 and 2,263,875.

As for magenta couplers which may be incorporated in the silver halide emulsions in this invention, the 5-pyrazolone series compounds are mainly used, but indazolone series compounds and cyanoacetyl compounds can also be used. Examples of such magenta couplers are described, for example, in U.S. Pat. Nos. 2,439,098, 2,600,788, 3,062,653, and 3,558,319, British Pat. No. 956,261, U.S. Pat. Nos. 3,582,322, 3,615,506, 3,519,429, 3,311,476 and 3,419,391.. Japanese Patent Application Nos. 21454/73 and 56050/73, West German Pat. No. 1,810,464, Japanese Patent Publication No. 2016/69, Japanese Patent Application No. 45971/73 and U.S. Pat. No. 2,983,608.

As for cyan couplers which may be incorporated in the silver halide emulsions in this invention, phenol derivatives and naphthol derivatives are used. Examples of such cyan couplers are described, for example, in U.S. Pat. Nos. 2,369,929, 2,474,293, 2,698,794, 2,895,826, 3,311,476, 3,458,315, 3,560,212, 3,582,322, 3,591,383, 3,386,301, 2,434,272, 2,706,684, 3,034,892 and 3,583,971, West German Patent Application (OLS) No. 2,163,811, Japanese Patent Publication No. 28836/70 and Japanese Patent Application No. 33238/73.

The silver halide emulsions used in this invention may also contain couplers of the type releasing a development inhibiting compound at coupling reaction thereof (so-called DIR couplers) or compounds releasing a development inhibiting compound. Examples of these couplers or compounds are described, for example, in U.S. Pat. Nos. 3,148,062, 3,227,554, 3,253,924, 3,617,291, 3,622,328 and 3,705,201, British Pat. No. 1,201,110, and U.S. Pat. Nos. 3,297,445, 3,379,529 and 3,639,417.

The above-described couplers may be incorporated in the same silver halide emulsion layer as a combination of two or more couplers, or a one type of coupler may be incorporated in two or more silver halide emulsion layers.

On the other hand, when the process of this application is applied to color radiographic materials, there is no particular restriction on the absorption wavelength regions of dye images, but dye images having absorptions in the whole absorption wavelength regions or cyan color images or blue color images having main absorption in a long wavelength region of red region (600 to 700 mμ) or green region (550 to 600 mμ) in visible spectra are preferred.

As the couplers for the radiographic materials used in this invention, phenolic couplers or α-naphtholic color couplers forming quinoneimine dyes having the maximum absorption in the spectral wavelength regions of 550 to 700 mμ are particularly preferred.

Examples of couplers used for these purposes are described, for example, in U.S. Pat. Nos. 2,772,162, 3,222,176, 3,758,308, 3,737,318, 3,591,383 and 3,476,563, British Pat. Nos. 1,201,110, 1,038,331, 727,693 and 747,628 and Japanese Patent Application (OPI) No. 4480/72.

The color couplers for the photographic materials may be dispersed by an oil solution dispersion system or in an aqueous solution dispersion system.

It is preferred from the viewpoint of rapid processing, etc., that the couplers for color radiographic materials have a hydrophilic group such as a carboxy group, sulfo group, etc., and in this case, an aqueous solution dispersion system is preferred.

The term "oil solution dispersion system" means that an oleophilic coupler is dissolved in a high boiling organic solvent and the solution obtained is directly dispersed as fine colloid particles in a silver halide photographic emulsion or the coupler solution is once dispersed in an aqueous medium and the dispersion is added to a silver halide photographic emulsion.

The silver halide photographic materials processed by the process of this invention may further contain various additives.

For example, there are chemical sensitizers, spectral sensitizing dyes, antistatic agents, dyes, plasticizers, brighteners, matting agents, surface active agents, etc., for silver halide emulsions and these additives are described in *Research Disclosure*, Vol. 176, pp. 22–31 (December, 1978).

In this invention, the exposure for obtaining photographic images may be conducted in an ordinary manner. That is, known various light sources, such as natural light (sunlight), a tungsten lamp, a fluorescent lamp, a xenon arc lamp, a carbon arc lamp, a xenon flash lamp, a cathode ray flying spot, etc., can be used. The exposure time employed may, as a matter of course, be from about 1/1,000 sec to 1 sec employed for ordinary camera, but may be shorter than 1/1,000 sec, for example, $1/10^4$ to $1/10^6$ sec employed in case of using a xenon flash lamp or a cathode ray tube and further may be longer than 1 sec. If necessary, the spectral composition of light used for the exposure may be adjusted by color filters. Furthermore, a laser light can be used for the exposure.

For the exposure of medical radiographic materials, an X-ray oscillation tube and a fluorescent intensifying screen are generally used, and although there is no particular restriction about the fluorescent intensifying screen used for color radiographic materials in this invention, the green-emitting intensifying screens described in U.S. Pat. No. 3,809,906 and Japanese Patent Application (OP) Nos. 52990/74 and 63424/74 are preferably used.

The invention will be explained in more detail by referring to the Example 1 below, using color radiographic materials, but the invention is not limited to this embodiment.

EXAMPLE 1

In 50 ml of an aqueous solution of 1 wt% sodium hydroxide was dissolved 3 g of the coupler having the following composition at 40° C.

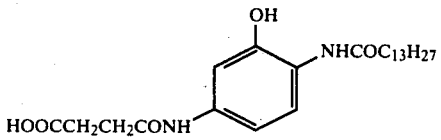

Then, to 57 g of a silver halide emulsion containing 5.4 g of silver chloroiodobromide (about 0.5% silver iodide) having a mean diameter of 0.5 to 1.5 microns and 7 g of gelatin were added 6 ml of an aqueous solution of 10 wt% citric acid and 2 ml of an aqueous solution of 5 wt% chromium alum and after adding thereto the above-mentioned coupler solution, the spectral sensitizing dye having the following structure was added to the mixture at about 0.08 mg per 50 mg of silver and then the pH thereof was adjusted to about 6.5 by the addition of a coating aid to provide a silver halide photographic emulsion.

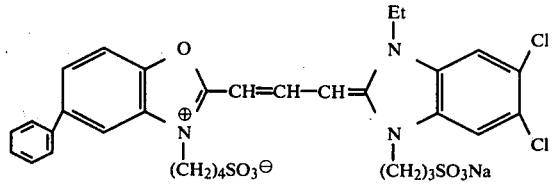

The silver halide emulsion was coated on the both surfaces of a polyester film of about 180 microns thick at a coverage of silver of about 50 mg/100 $cm^2$ to provide a photographic material.

The photographic film was exposed through Filter SP-15 (made by Fuji Photo Film Co., Ltd.) to a tungstem lamp and then processed as follows using a roller conveyer type automatic processor.

| Processing Step | Temperature (°C.) | Time |
|---|---|---|
| Color Development | 42 | 22 sec |
| Fixing | 35 | " |
| Washing | 25 | " |
| Drying | 50 | 18 sec |

The compositions of the processing solutions used in the above processing steps were as follows:

| Color Developer | |
|---|---|
| Ethylenediaminetetraacetic acid disodium salt | 2 g |
| Sodium sulfite | 10 g |
| N,N-Diethylhydroxylamine | 5.0 ml |
| N-Ethyl-N-methoxyethyl-3-methyl-p-phenylenediamine-1-toluenesulfonate | 10.0 g |
| 1-Phenyl-4-methyl-4-hydroxyl-3-pyrazolidone | 1.0 g |
| Potassium carbonate | 30.0 g |
| Potassium bromide | 2.0 g |
| 5-Nitroindazole | 30.0 mg |
| Polyethylene glycol | 0.1 g |
| Water to make | 1 l |
| | pH adjusted to 10.2 |

Furthermore, Compound (5), (11) or (16) in this invention was incorporated in the above-mentioned color developer solution and the pH was adjusted to 10.2.

FIXING SOLUTION

An acid hardening fixing solution (Fuji. 'F, trademark, made by Fuji Photo Film Co., Ltd.) having a pH of about 4.3 was used.

The photographic films processed by the automatic processor were then dried.

The density (visual density) of each of the photographic films thus processed was measured using a photographic densitometer.

The photographic properties obtained using these color developers and the acid hardening fixing solution are shown in the following table. The specific sensitivity value shown in Table 1 is shown as a relative value, with the exposure amount necessary to obtain fog+photographic density of 1.0 without addition is taken as 100.

TABLE 1

| Compound Added to Color Developer | Amount Added (g/l) | Specific Sensitivity | Contrast | Maximum Density | Fog |
|---|---|---|---|---|---|
| None | — | 100 | 2.10 | 2.85 | 0.07 |
| Compound (5) | 1.6 | 120 | 2.35 | 3.10 | 0.05 |
| Compound (11) | 0.8 | 112 | 2.25 | 3.25 | 0.06 |
| Compound (16) | 0.4 | 133 | 2.42 | 3.15 | 0.05 |

As is clear from the results shown in Table 1, by the use of the compounds in this invention, very preferred photographic properties, i.e., improved sensitivity, contrast, and maximum density, and less fog, were obtained.

Furthermore, in all samples in Table 1, silver halide was almost completely developed and, thus, the fact that maximum density in the samples according to this invention is higher than the sample for control means that destruction of dye image in the samples according to this invention was remarkably prevented.

Moreover, X-ray photograph requires the maximum density of at least 3.0 and such requirement can be satisfied in the samples according to this invention. Thus, when this invention is applied to a medical X-ray photograph, high maximum density and high contrast according to this invention make easy to diagnose.

While the invention has been described in detail and with reference to specific embodiments thereof, it will be apparent to one skilled in the art that various changes and modifications can be made therein without departing from the spirit and scope thereof.

What is claimed is:

1. A color photographic process for simultaneously producing silver image and dye image which comprises developing an imagewise exposed silver halide photographic material containing a dye-forming coupler using a color developer solution containing components (1) an aromatic primary amino color developing agent, (2) a 1-aryl-3-pyrazolidone compound having two substituents at the 4-position, and (3) at least one compound selected from compounds represented by the formulae (I) and (II)

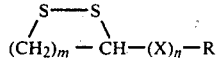

(I)

-continued

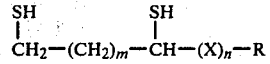

(II)

wherein X represents a hydrocarbon group having 1 to 6 carbon atoms; R represents a carboxylic acid group, a water-soluble carboxylic acid salt group, a water-soluble carboxylic acid ester group, or a water-soluble carboxylic acid amide group; m is 1 or 2; and n is 0 or 1, and then fixing the photographic material using an acid hardening fix solution.

2. A color photographic process as in claim 1, wherein said color developer solution contains the aromatic primary amino color developing agent in an amount of from about 0.1 to 50 g per liter of color developer solution.

3. A color photographic process as in claim 2, wherein said color developing agent is present in an amount of from 1 to 20 g per liter of color developer solution.

4. A color photographic process as in claim 1, 2 or 3, wherein said aromatic primary amino color developing agent is selected from the group consisting of N,N-diethyl-p-phenylenediamine hydrochloride, 2-amino-5-diethylaminotoluene hydrochloride, 2-amino-5-(N-ethyl-N-laurylamino)toluene, 4-N-ethyl-N-(β-hydroxyethyl)amino aniline sulfate, 2-methyl-4-N-ethyl-N-(β-hydroxyethyl)-amino aniline sulfate, N-ethyl-N-(β-methanesulfonamidoethyl)-3-methyl-4-amino aniline sesquisulfate monohydrate, N-(2-amino-5-diethylaminophenylethyl)methane sulfonamide sulfate, N,N-dimethyl-p-phenylenediamine hydrochloride, 4-amino-3-methyl-N-ethyl-N-methoxyethylaniline, 4-amino-3-methyl-N-ethyl-N-β-ethoxyethylaniline, 4-amino-3-methyl-N-ethyl-N-β-butoxyethylaniline, and salts thereof.

5. A color photographic process as in claim 1, wherein the 1-aryl substituent of the 1-aryl-3-pyrazolidone derivative is a phenyl group.

6. A color photographic process as in claim 5, wherein substituents on said phenyl group have a substituent constant of from about −0.9 to +0.9.

7. A color photographic process as in claim 5, wherein said substituents on said phenyl group have a substituent constant of from −0.40 to +0.25.

8. A color photographic process as in claim 5, wherein said phenyl group is substituted with substituent groups selected from p-OH, p-$CH_3O$, m-$(CH_3)_2N$, p-$(CH_3)_3C$, p-$CH_3$, m-$NH_2$, p-$C_2H_5$, p-$(CH_3)_2CH$, m-$(CH_3)_3Si$, m-$CH_3$, p-$CH_3S$, p-$C_6H_5O$, p-$NHCOCH_3$, m-OH, p-$C_6H_5$, p-F, m-$CO_2^{\ominus}$, m-$CH_3O$, p-$CO_2^{\ominus}$, m-$CH_3S$, m-$C_6H_5$, p-Cl, and p-Br.

9. A color photographic process as in claim 1, wherein said component (3) consists of a compound according to formula (I).

10. A color photographic process as in claim 1, wherein said component (3) consists of a compound according to formula (II).

11. A color photographic process as in claim 1, wherein said component (3) comprises at least one compound selected from the group consisting of

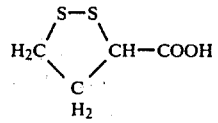

-continued

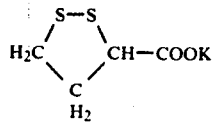

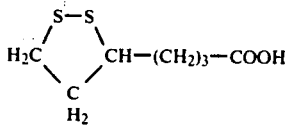

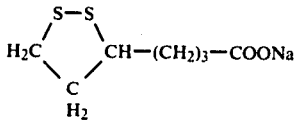

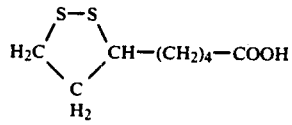

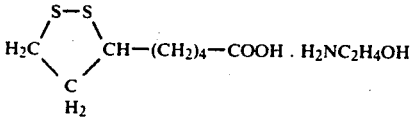

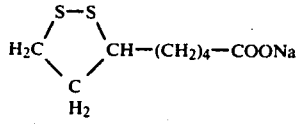

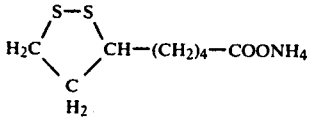

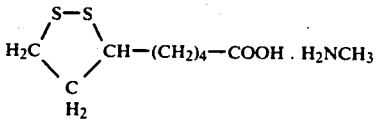

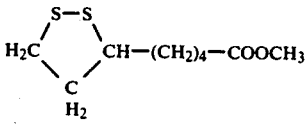

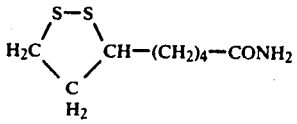

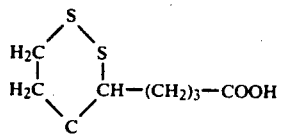

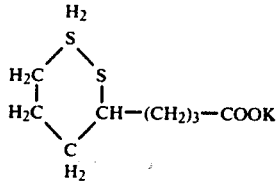

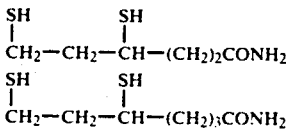

-continued

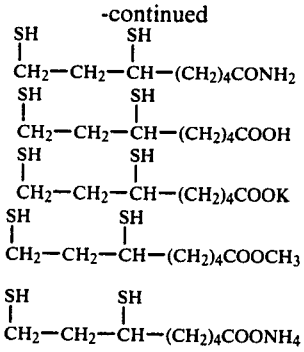

and

12. A color photographic process as in claim 1, wherein the amount of compound constituting component (3) in the color developer solution is from about 0.01 g to 5.0 g per liter of color developer solution.

13. A color photographic process as in claim 1, wherein the amount of compound constituting component (3) in the color developer solution is from about 0.05 g to 2.0 g per liter of color developer solution.

14. A color photographic process as in claim 1, 2, 3, 5, 6, 7, 8, 9, 10, 11, 12 or 13, wherein the pH of the color developer solution is from about 7 to 14.

15. A color photographic process as in claim 14, wherein the pH of the color developer solution is from about 8 to 13.

16. A color photographic process as in claim 1, 2, 3, 5, 6, 7, 8, 9, 10, 11, 12, or 13, wherein the temperature of the color developer solution is maintained from about 20° to 70° C.

17. A color photographic process as in claim 16, wherein the temperature of the color developer solution is maintained in the range from 30° to 60° C.

18. A color photographic process as in claim 1, wherein said X represents an alkylene group.

19. A color photographic process as in claim 1, wherein said water-soluble carboxylic acid salt of R is an alkali metal salt, an alkaline earth metal salt, an ammonium salt or an amine salt.

20. A color photographic process as in claim 1, wherein said water-soluble carboxylic acid ester of R is an ester with alkyl group having 1 to 4 carbon atoms.

21. A color photographic process as in claim 1, wherein said water-soluble carboxylic acid amide is a carboxylic acid amide or a carboxylic acid amide substituted with alkyl group having 1 to 4 carbon atoms.

22. A color photographic process as in claim 1, wherein the amount of said 1-aryl-3-pyrazolidone compound is from about 0.01 g to 10 g per liter of color developer solution.

23. A color photographic process as in claim 1, wherein the amount of said 1-aryl-3-pyrazolidone compound is from 0.05 g to 5 g per liter of color developer solution.

24. A color photographic process as in claim 1, wherein said acid hardening fix solution is an aqueous solution containing at least a thiosulfate and a water-soluble aluminum compound.

25. A color photographic process as in claim 1, wherein said dye-forming coupler is a coupler providing dye images having absorptions in the whole absorption wavelength regions or cyan color images or blue color images having main absorption in a long wavelength region of red region (600–700 mμ) or green region (550–600 mμ) in visible spectra.

26. A process for producing a radiographic photographic image according to the process of claim 1.

* * * * *